United States Patent [19]

Hansen

[11] 4,202,088

[45] May 13, 1980

[54] SPARK PLUG BOOT PULLER

[76] Inventor: Laird H. Hansen, 407 N. Northwest Hwy., Palatine, Ill. 60067

[21] Appl. No.: 940,432

[22] Filed: Sep. 7, 1978

[51] Int. Cl.[2] ..... B25B 27/14

[52] U.S. Cl. ..... 29/280; 29/764

[58] Field of Search ..... 29/764, 278, 280, 239; 81/3 R

[56] References Cited

U.S. PATENT DOCUMENTS

| | | | |
|---|---|---|---|
| 1,728,619 | 9/1929 | Lambert | 30/343 |
| 3,103,836 | 9/1963 | Bristol | 29/278 |
| 3,160,947 | 12/1964 | Sunberlin | 81/3 R |
| 4,096,618 | 6/1978 | Perline et al. | 29/278 |
| 4,125,938 | 11/1978 | Clark | 29/268 |

*Primary Examiner*—James L. Jones, Jr.
*Attorney, Agent, or Firm*—Kenneth T. Snow

[57] ABSTRACT

A tool for the removal of lead wire boots from the spark plugs of internal combustion engines. The tool has an L-shaped steel hook adapted to engage the underside of a spark plug boot and permit its removal by an upward pulling of the tool. The tool has an elongated silicone elastomer handle molded integrally to the steel hook through openings in a shank thereof. The thick rubber-like silicone handle fully electrically insulates the user from the hook and thus also the high voltages carried by the spark plugs. The handle is sufficiently flexible to permit the user to insert the tool through the maze of appurtenances of the present day crowded engines into the area of the spark plugs. The flexible handle is endowed with sufficient strength to pull the spark plug boots and is equipped with a flat circular ring for easy gripping by the user and for conveniently hanging on a hook when the tool is not in use.

2 Claims, 5 Drawing Figures

SPARK PLUG BOOT PULLER

BACKGROUND OF THE INVENTION

1. Field of the Invention

Present day automobiles employ internal combustion engines housed in body compartments that include many other appurtenances in addition to the engine. The crowded nature of these compartments makes it difficult to service the engine. Access to the spark pluge through a maze of cables, tubes, hoses, etc. is now a major task. To even get in and pull a lead off a spark plug is quite an accomplishment. And, when the engine is running and developing 35,000 or more volts at each spark plug the task of safely pulling a lead from that plug is even greater. The present invention concerns a manually operated tool for engaging the boot of a spark plug lead wire and the attendant safely pulling it free of the plug when the engine is either turned off or running without being burned by the hot engine. The tool is flexible so that it may be inserted in and around the crowded engine chamber to reach the spark plug and has electrically insulating qualities such that the user is fully safe from any high voltage electric shocks.

2. Description of the Prior Art

Tools having plastic or other handles of insulating materials have long been used. Screw drivers are a good example. However, no tools are known which have combination flexible and insulating handles and wherein both characteristics are essential to the effective operation and use of that tool.

The spark plug embodiments in engines have undergone a gradual evolution over the years of automobile manufacture. Initially lead wires from a distributor were attached to the tops of the plugs by nuts engaging a threaded center terminal. Later, spring snap-on devices on the ends of lead wires were used to effect connections to the center terminals of spark plugs. Still later, boots were added to the ends of spark plug lead wires. The boots acted to enclose the electrical connection of the lead wires to the plugs and also to keep the plug's porcelain insulators shielded from the deposit thereon of the oily grime of an engine. More recently the spark plug lead wires have been made from carbon impregnated strands instead of the usual conductor wire for the purpose of suppressing radio frequency interference. As a result the automobile radios operate without undesirable static. This is an important technological advancement but such carbon impregnated strands are very susceptible to damage and the effectiveness of radio frequency interference suppression is easily destroyed by rough handling.

Still another advance in this field is the use of silicone insulation for ignition cables because of the development of high voltages and the carrying of this high energy in such ignition cables. Here too, insulations such as silicone, have a tendency to be damaged by rough handling. It is important that these insulations not be punctured for them to operate successfully.

Quite often mechanics will use pliers to grasp either the spark plug lead wires or their integral boots in effecting removal of those lead wires from the plugs. Automobile manufacturers advise against the use of pliers or any rough handling which can and usually does damage the cable and its insulation.

The device of this invention gives the automobile mechanic a tool to remove spark plug boots without damage to the sophisticated lead wires or their insulations.

SUMMARY OF THE INVENTION

A principal object of the present invention is to provide a novel tool for safely and effectively removing spark plug leads in the crowded engine compartments of current automobiles without damaging the spark plug lead wires.

An important object of this invention is to provide a novel spark plug lead removing tool which is flexible throughout the major portion of its length to permit it to be inserted into and around the crowded area of the engine compartment of an automobile in order to reach the spark plugs of the engine.

Another important object of this invention is to provide a novel spark plug lead removing tool which safely insulates the user from the high voltages passing through the spark plugs when the engine is running.

Still another important object of this invention is to provide a novel spark plug lead removing tool which in addition to being flexible and having electric insulating qualities has substantial strength and easily permits the pulling of spark plug leads regardless of the force necessary to effect such removal.

Another and still further important object of this invention is to provide a hand tool made of metal and having a flexible handle terminating in a ring member which functions as an effective engagement for hand pulling of the tool and as a means for supporting the tool on a hook when the tool is not in use.

A still further important object of this invention is to provide a novel spark plug boot removal tool which does not damage the lead wires, does not damage the insulation on the lead wires, and does not damage the boots on the ends of the lead wires such as often occurs when mechanics use other devices to effect spark plug boot and lead wire removal.

Other and further important objects and advantages of this invention will become apparent from the disclosures in the following specification and accompanying drawings.

IN THE DRAWINGS

AS SHOWN IN THE DRAWINGS

Figure 3:
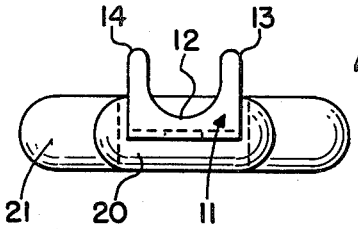
FIG. 3 is an end view of the tool of FIG. 1.

The reference numeral 10 indicates generally an L-shaped steel member which constitutes the core of the tool of this invention. This L-shaped member includes a flat base portion 11 having a semi-circular cut-out portion 12 therein as best shown in FIG. 3 of the drawings. The semi-circular portion 12 is flanked by side fingers 13 and 14 disposed parallel to one another.

Figure 1:
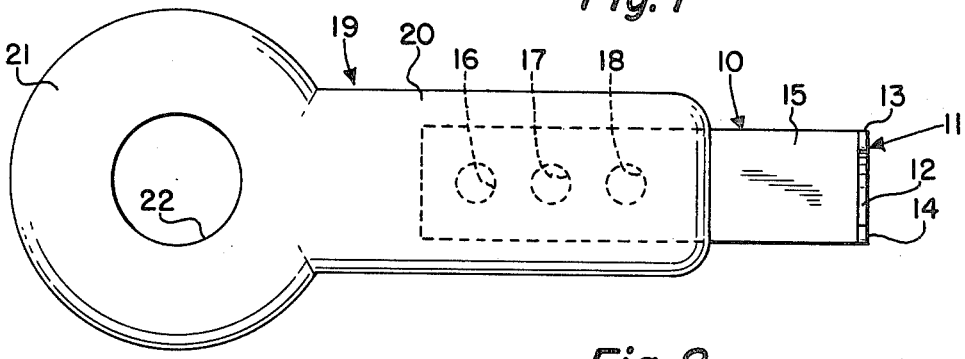
FIG. 1 is a plan view of the spark plug lead wire boot puller tool of this invention.
Figure 2:
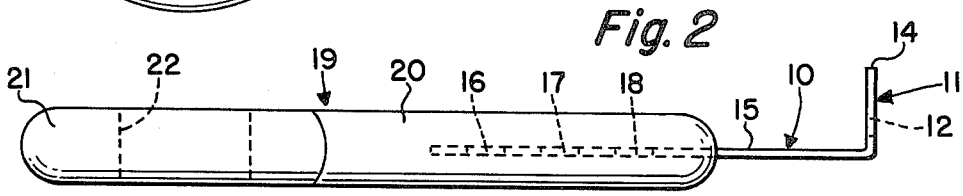
FIG. 2 is a side view of the tool of FIG. 1.

The L-shaped steel member 10 further includes a shank portion 15 which lies at 90° to the base 11 thereof. The shank portion 15 is generally flat and is provided with holes therethrough at 16, 17 and 18 as shown in FIGS. 1 and 2. These holes 16, 17 and 18 are located near the upper end of the shank 15 and are disposed at spaced intervals along the length thereof. The function of the holes is to provide an interlock between the L-shaped steel member 10 and a flexible handle.

The handle 19 of the tool is comprised of a flexible silicone rubber. The flexing of the tool throughout the extent of its handle portion permits access of the tool into and around other appurtenances to reach the spark plugs in a crowded engine compartment of an automobile. Another and very important function of the handle 19 is to provide an adequate electrical insulation for the user of the tool from the steel core part of the tool 10 when that portion 10 is in contact with electrically discharging spark plugs. The handle 19 is provided with a shank portion 20 which is molded into and around the holes 16, 17 and 18 of the steel core 10 to form an integral fixed bond of the silicone rubber handle 19 with the L-shaped steel member 10. The shank portion 20 extends beyond and in alignment with the steel core shank portion 15. The upper end of the handle 19 is equipped with an enlarged ring shaped hand engaging portion 21 which has a hole 22 in the center thereof. The hole 22 is used for engagement by the hand of the user at a time when the tool is in use and to provide means for carrying the tool on a hook when the tool is not in use.

Figure 4:
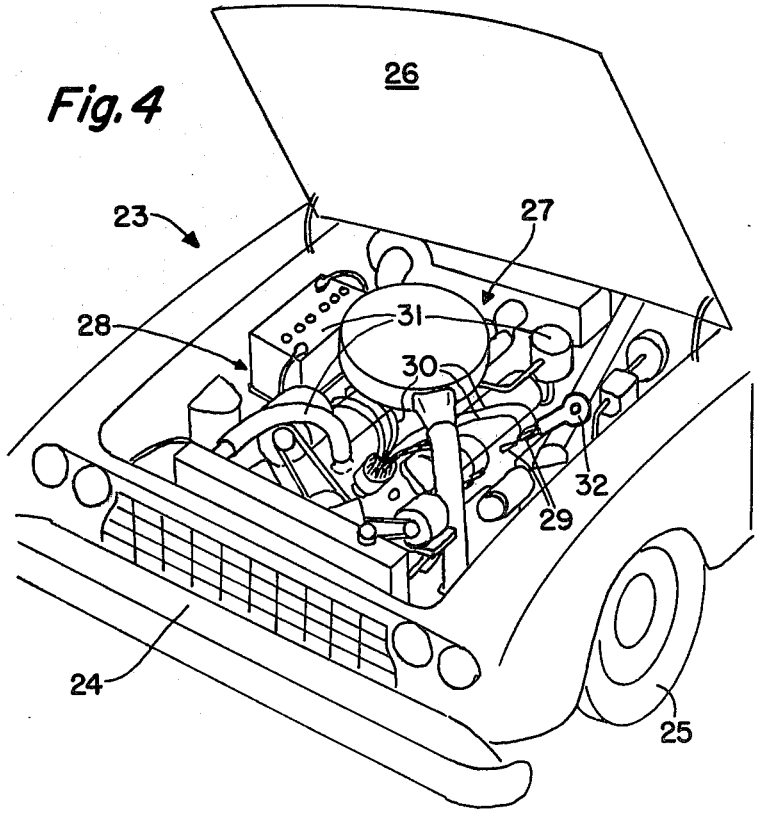
FIG. 4 is a perspective view of a portion of an automobile with the engine hood raised and exposing the internal combustion engine therein and further showing the engagement of one of the spark plug's lead boot by the pulling tool of this invention.

As best shown in FIG. 4 an automobile, partially broken away, is indicated at 23. The front end 24 of the automobile is supported by wheels 25. A hood or door 26 of the automobile is shown in an up or open position and is adapted to cover an engine compartment 27 when it is closed. It should be understood that present day automobiles are built with engine compartments located at any place in their bodies. However, the location of the engine compartment is unimportant relative to the present invention and thus only an engine compartment located at the front of a vehicle has been illustrated. Within the compartment 27 there is positioned an engine 28, generally of the internal combustion type, and having a plurality of spark plugs 29 for igniting the combustible gas mixtures at certain times in the engine operation. Lead wires 30 are adapted to engage the spark plugs and function to deliver electrical power thereto for the purpose of discharging sparks within the engine.

Present day automobiles, in addition to having engines as power sources to propel the automobiles, are usually equipped with heaters, air conditioners, radios and tape players. These automobiles also have automatic transmissions, power brakes, power steering, and many automated and power assist devices to control various components used in and about the automobile. All of these devices require space within or closely adjacent to the engine compartment 27. Thus the compartment 27 is indeed a crowded space in the automobile with conduit, hoses and wires servicing the numerous devices which are generally indicated by the numeral 31. These miscellaneous appurtenances 31 in addition to the engine 28 create an extremely crowded condition in the compartment 27. Access to the spark plugs in the crowded compartment 27 is very difficult. The tool of this invention is such that it may be utilized to remove the spark plug lead wires from the spark plugs in this crowded compartment either when the engine is operating or when it is not running. The tool of this invention identified as 32 in FIG. 4 is shown engaging a spark plug 29 immediately beneath the lead wire 30 so that upon an upward pulling of the tool 32 the lead wire 30 is pulled free from the spark plug 29. As stated above there are many objects in the way of reaching the spark plugs and thus the flexible handle of the tool 32 is utilized to weave the tool 32 in and through the maze of devices for the purpose of engaging the spark plug.

Figure 5:
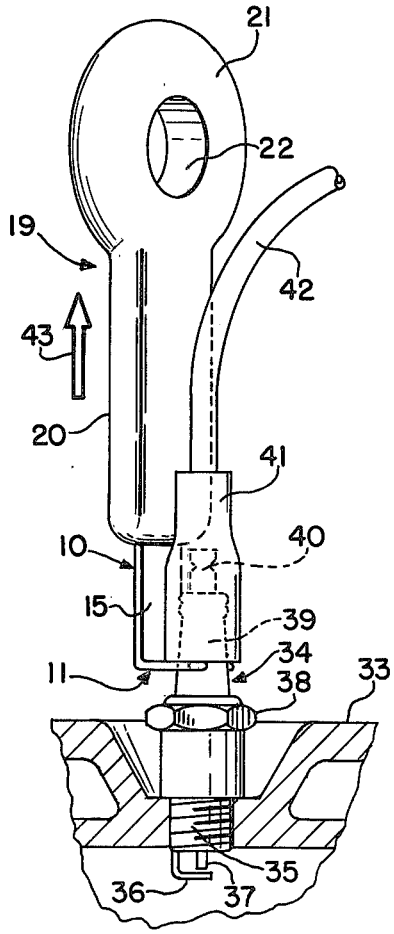
FIG. 5 is an enlarged detail view, partially in section, of the engagement of the spark plug lead wire boot by the pulling tool of this invention.

FIG. 5 shows an enlarged detail of a spark plug and its lead wire with the tool of this invention thereon for the purpose of stripping the lead wire from the spark plug. An engine wall 33 has been shown in cross section and a spark plug 34 has its lower threaded shank 35 threadedly engaged in an opening in the wall 33. Spark plug electrodes 36 and 37 having a proper spacing depend from the spark plug 34 and into the chamber within the engine wall 33. It is across these two electrodes that the spark discharges to cause an ignition of the flammable mixture delivered to that chamber. The upper portion of the spark plug 34 includes a wrench engaging portion 38 which is of hexagonal shape. Above the wrench engaging portion is a tapered porcelain insulator 39. A top terminal or post 40 is provided on the plug 34 to which a boot 41 from a lead wire 42 is attached. The lead wire 42 carries electrical power from a power source to the spark plug 34. The lead boot 41 is generally an enlarged end portion of the lead 42 and is equipped with a socket which snaps with a spring action onto the top terminal post 40 of the plug 34. Present day automobile engines develop 35,000 volts or more at each spark plug when the engines are operating. Thus it is dangerous for anyone servicing the automobile to remove the spark plug leads when the engine is in operation without some means of insulating themselves from this danger. Failure to be electrically insulated would most assuredly result in an extreme electrical shock to the service attendant. However, with the tool of this invention spark plug lead wires may be safely removed from the spark plugs while the engine is running thus permitting a service man to gain meaningful readings on their sophisticated equipment for the testing of engines.

When a service man desires to remove a lead wire from a spark plug and especially with the engine in operation he grips the removal tool of this invention by the ring shaped top portion 21 of the handle 19 and preferably through the center hole 22 thereof. The handle 19 has substantial thickness to give adequate electrical insulation to the user and is quite flexible to thus permit the user to insert the tool down through the maze of devices, conduits, etc. 31 where the spaced apart parallel fingers 31 and 14 are inserted beneath the boot 41 and around the post 40 at the top of the spark plug porcelain insulator 39. The semi-circular notch 12 of the tool lies in abutting engagement with the terminal post 40 of the spark plug 34. At this time the service man exerts an upward pulling force on the handle 19 in the direction of the arrow 43 causing the boot 41 to be stripped free of the terminal post 40. Although the handle 19 is flexible it is designed with great strength so that it is quite adequate to effect removal of the lead boot without undue stretching of the handle.

I am aware that numerous details of construction may be varied throughout a wide range without departing from the principles disclosed herein and I therefore do not propose limiting the patent granted hereon otherwise than as necessitated by the appended claims.

What is claimed is:

1. A tool for pulling the lead wires from engine spark plugs comprising an L-shaped steel core, said core having a flat base portion with a semi-circular cut-out therein flanked on each side by generally parallel side fingers, said core having a flat shank portion with a plurality of holes therethrough, a flexible plastic electrically insulating handle molded over and around the flat shank portion of the steel core and covering and filling the holes so that there is an interlock between the steel core and the flexible plastic handle, said flexible plastic handle having a shank portion extending beyond and in alignment with the steel core shank and said flexible plastic handle terminating in a flat ring hand engaging portion.

2. A device as set forth in claim 1 in which the flexible plastic electrically insulating handle is made of a silicone rubber.

* * * * *